United States Patent [19]

Toya et al.

[11] Patent Number: 5,006,449

[45] Date of Patent: Apr. 9, 1991

[54] SILVER HALIDE BLACK AND WHITE PHOTOGRAPHIC MATERIAL

[75] Inventors: Ichizo Toya, Kanagawa; Kunioki Ohmura, Tokyo; Masaki Okazaki, Kanagawa, all of Japan

[73] Assignee: Fuji Photo Film Co., Ltd., Kanagawa, Japan

[21] Appl. No.: 368,944

[22] Filed: Jun. 13, 1989

Related U.S. Application Data

[63] Continuation-in-part of Ser. No. 128,304, Dec. 3, 1987, abandoned.

[30] Foreign Application Priority Data

Dec. 3, 1986 [JP] Japan ..... 61-288099

[51] Int. Cl.[5] ..... G03C 1/12; G03C 5/02; G03C 5/08

[52] U.S. Cl. ..... 430/508; 430/356; 430/358; 430/570; 430/606; 430/536; 430/496

[58] Field of Search ..... 430/356, 358, 363, 508, 430/570, 571, 1, 2, 606, 496, 536

[56] References Cited

U.S. PATENT DOCUMENTS

| | | | |
|---|---|---|---|
| 2,358,060 | 9/1944 | Davey | 430/571 |
| 2,358,169 | 9/1944 | Kridel | 430/571 |
| 3,628,960 | 12/1971 | Philippaerts et al. | 430/571 |
| 4,803,152 | 12/1989 | Momoki et al. | 430/570 |

*Primary Examiner*—Richard L. Schilling

*Attorney, Agent, or Firm*—Sughrue, Mion, Zinn, Macpeak & Seas

[57] ABSTRACT

A silver halide black and white photographic material for printing a developed transparent color photographic material is disclosed, which comprises a support having thereon at least one light-sensitive silver halide emulsion layer, wherein the emulsion layer is composed of a silver halide emulsion which maintains a spectral sensitivity substantially between 520 nm and 620 nm and contains substantially no iodine.

18 Claims, 1 Drawing Sheet

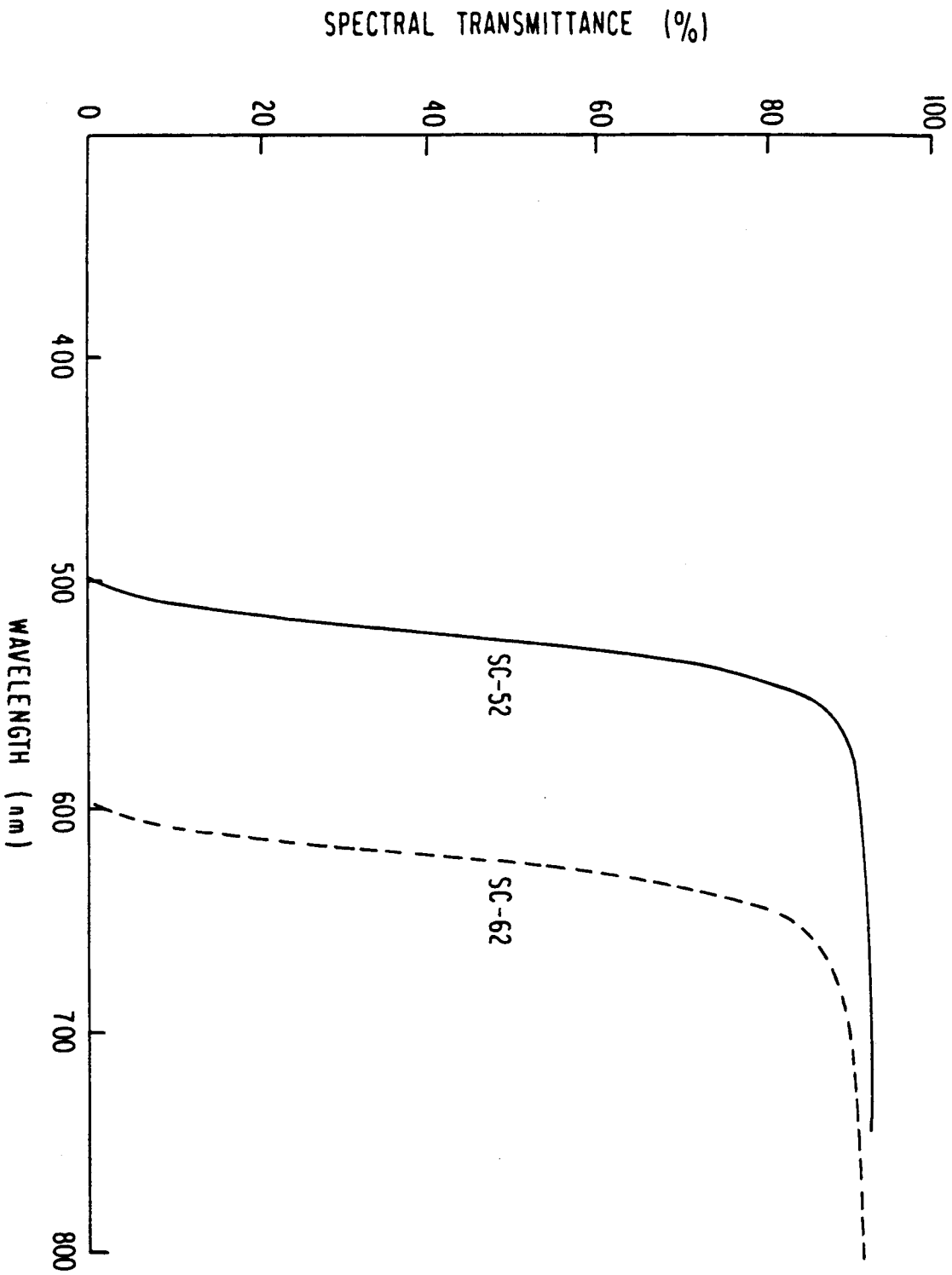
SPECTRAL TRANSMITTANCE (%)
100
80
60
40
20
0
400
500
600
700
800
WAVELENGTH (nm)
SC-52
SC-62

SILVER HALIDE BLACK AND WHITE PHOTOGRAPHIC MATERIAL

This is a Continuation-in-part, of application Ser. No. 07/128,304, filed Dec. 3, 1987, now abandoned.

FIELD OF THE INVENTION

This invention relates to a silver halide black and white photographic material for viewing silver images formed thereon, and more particularly to a silver halide photographic material which is used for printing a developed transparent color photographic material which has excellent handlability and image qualities.

BACKGROUND OF THE INVENTION

As a silver halide black and white photographic material for printing a developed or processed transparent color photographic material (e.g., a color negative photographic film), a blue spectral-sensitized black and white photographic paper and a panchromatically sensitized black and white photographic paper are well known. However, when the former type of photographic paper is used for printing a developed transparent color photographic material, the graininess of the images formed is very poor since such a photographic paper mainly contains yellow colored images of the developed transparent color photographic material as information. Hence, the images formed are unsuitable for viewing. the other hand, since in the latter type of panchromatic photographic paper, the safelight for the printing is limited to panchromatic light or infrared light, the working place for the printing is restricted and further, since the safelight for handling the photographic paper is dark, it is impossible to perform the work while confirming the progressing state of the development of the photographic paper, this results in a reduction of the finished quality of the print. Also, since the panchromatic photographic paper picks up cyan colored images of a developed transparent color photographic material as information, the sharpness of the images formed is reduced.

SUMMARY OF THE INVENTION

Objects of this invention are, therefore, to provide a silver halide black and white photographic material for printing a developed transparent color photographic material and viewing the silver images formed thereon, which has excellent handlability and image qualities (graininess, sharpness, etc.).

The above-described objects of the present invention have been met by a silver halide black and white photographic material comprising a support having thereon at least one light-sensitive silver halide emulsion layer which is used for printing a developed transparent color photographic material, wherein the spectral sensitivity of the silver halide emulsion layer is maintained in the range of substantially from 520 nm to 620 nm.

BRIEF DESCRIPTION OF THE ACCOMPANYING DRAWING

The accompanying drawing is a graph indicating spectral transmittance to wavelength of Sharp Cut Filters SC-52 and SC-62 both of which are made by Fuji Photo Film Co., Ltd., respectively.

DETAILED DESCRIPTION OF THE INVENTION

In this invention, the use of a support having a white color-reflective layer is more advantageous in terms of the handling performance. Also, the silver halide in the silver halide emulsion layer is preferably silver halide grains containing substantially no iodine. The term "silver halide grains containing substantially no iodine" as used herein means "silver halide grains containing iodine of less than 1 mol %". This is because silver halide grains substantially containing iodine (i.e., containing 1 mol % or more of iodine) have high sensitivity for yellow colored images. This results in a reduction of the graininess of the images obtained.

In this invention, the gradation of the silver halide photographic material can be controlled by using a monodispersed silver halide emulsion containing no or substantially no iodine singly or a mixture of such monodispersed silver halide emulsions, or using a silver halide emulsion having a broad grain size distribution singly or a mixture of such silver halide emulsions having a broad grain size distribution. The preferred gradation is in the range of from R110 to R70 as the ISO range and in such a case, the black and white photographic material matches the $\gamma$ value of a transparent color photographic material to give good image quality (tone). It is preferred that the maximum density is at least 2.0.

The most preferred embodiments of the present invention have the following characteristics:

(1) The graduation of an image obtained after processing does not change even if the exposure wavelength is varied.

(2) When two or more silver halide emulsions are used, the silver halide compositions are substantially the same.

(3) When two or more silver halide emulsions are used, their spectral sensitivities are substantially the same.

(4) The silver halide emulsions used are normally monodispersed ones.

In this invention, the silver halide emulsion having a spectral sensitivity which is maintained substantially between 520 nm and 620 nm is defined as follows.

After exposing each emulsion-coated sample through a continuous wedge to a tungsten light of 2854 K and 400 lux for one second, the sample is developed for 90 sec. at 20° C. using a developer obtained by diluting a commercially available developer, Papitol (trade name, made by Fuji Photo Film Co., Ltd.) with water at 1:1, stopped, fixed for 5 minutes using a fixer, Fuji Fix (trade name, made by Fuji Photo Film Co., Ltd.), washed with water, and then dried.

The photographic sensitivity thereof is obtained by the following formula using an exposure amount "H (lux x sec)" giving an optical density of the fog density +0.6 (in optical density);

$$\text{Sensitivity} = \frac{1000}{H}$$

(1) Sensitivity (I)

The sensitivity in the case of exposing each sample without using a filter.

(2) Sensitivity (II)

The sensitivity in the case of exposing each sample through Sharp Cut Filter SC-52 (trade name, made by Fuji Photo Film Co., Ltd.).

(3) Sensitivity (III)

The sensitivity in the case of exposing each sample through Sharp Cut Filter SC-62 (trade name, made by Fuji Photo Film Co., Ltd.).

Spectral transmittance distribution of Sharp Cut Filters SC-52 and SC-62 is shown as the accompanying drawing.

$$\text{Relative Sensitivity } (A) = \frac{\text{Sensitivity (II)}}{\text{Sensitivity (I)}}$$

$$\text{Relative Sensitivity } (B) = \frac{\text{Sensitivity (III)}}{\text{Sensitivity (I)}}$$

A sample having of Relative Sensitivity (A) of at least 1/10 and Relative Sensitivity (B) of not more than 1/30 is a sample having a spectral sensitivity maintained substantially between 520 nm and 620 nm, i.e., the silver halide emulison for use in this invention.

In a preferred silver halide emulsion, Relative Sensitivity (A) is at least 1/6 and Relative Sensitivity (B) is not more than 1/30, and in more preferred silver halide emulsion, Relative Sensitivity (A) is at least 1/6 and Relative Sensitivity (B) is not more than 1/100.

In this invention, a water-impermeable support is preferably used as a support for the silver halide black and white photographic material. The term "water-impermeable support" as used herein means a support which does not permeate water or very little permeates water therethrough.

As such a support, there are a whitened plastic film formed by coating a dispersion of a white pigment such as titanium white, etc., in a binder such as gelatin, etc., on a transparent plastic film such as a cellulose triacetate film, a polyethylene terephthalate film and a paper support both surfaces of which are coated with a hydrophobic polymer such as polyethylene, etc. A matted support is preferably used in this invention. The thickness of the support is preferably not thinner than 200 μm from the point of handlability of the print obtained.

The silver halide in the silver halide photographic material of this invention is a silver halide containing no or substantially no (less than 1 mol %) iodine, such as silver chloride, silver chlorobromide, or silver bromide having high solubility in developer and showing fast development rate. There is no particular restriction on the mean grain size of the silver halide grains for use in this invention but it is preferred that the mean grain size is not larger than 4 μm. Also, from the point of the tone as a photographic material for printing a developed negative color photographic film, it is preferred that the mean grain size is not smaller than 0.35 μm.

The silver halide grains in the photographic emulsion used in the present invention may have a regular crystal shape, for example, that of a cube, an octahedron, a rhombic dodecahedron, or a tetradecahedron, or may comprises an irregular crystal shape, for example, that of a sphere, a plate, or further may be tabular grains having an aspect ratio of 5 or more as described in *Research Discrosure,* Vol. 225, pages 20–58 (January, 1983), or may be of a composite crystal form based on these shape.

Furthermore, the silver halide grains may have a junction structure by epitaxial overgrowth or a multilayer structure in which the interior and the surface of the grains differ in halide composition.

The grain size distribution of the silver halide emulsion may be broad or narrow. The latter emulsion is known as a so-called monodispersed silver halide emulsion and the dispersion coefficient (i.e., standard deviation divided by the mean grain size) is not more than 20%, preferably not more than 15%.

Also, a known silver halide solvent can be used at the formation of the silver halide grains.

The silver halide emulsions used in the present invention may be prepared by any of the methods known in the art of silver halide photographic materials, such as those described in P. Glafkides, *Chimie et Physique Photographique,* Paul Montel Co., Paris (1967); G.F. Duffin, *Photographic Emulsion Chemistry,* The Focal Press, London (1966); and V.L. Zelikman et al., *Making and Coating Photographic Emulsions,* The Focal Press, London (1964). Any of the acidic method, neutral method, and ammonia method may be used for the preparation of the photographic emulsion. A water-soluble silver salt may be reacted with a water-soluble halide salt by either the single jet method, the double jet method or a combination thereof.

As the silver halide emulsion, a so-called primitive emulsion which is not chemically sensitized may be used in this invention. However, the silver halide emulsion for use in this invention is preferably chemically sensitized. For the chemical sensitization, the methods described in P. Glafkides, *Chimie et Physique Photographique,* published by Paul Montel, 1967, V.L. Zelikman et al., *Making and Coating Photographic Emulsion,* published by Focal Press, 1964, and H. Frieser, *Die Grundlaqen der Photographischen Prozesse mit Silverhalogeniden,* published by Akademische Verlagsgesellschaft, 1968 can be used.

That is, a sulfer sensitization method using a sulfur compound such as thiosulfates, thioureas, thiazoles, rhodanines, etc., or active gelatin; a reduction sensitization method using stannous salts, amines, hydrazines, formamizinesulfines, silane compounds, etc., and a noble metal sensitization method using gold complex salts or complex salts of group VIII metals in the periodic table, such as paradium, iridium, platinum, etc., can be used individually or as a combination thereof.

In this invention, however, from the view point of fog obtained upon printing the photographic material, it is preferred that noble metal sensitization is not substantially applied to the silver halide emulsion.

Also, for the purposes of increasing sensitivity, increasing contrast, and/or accelerating development, the silver halide emulsion for use in this invention may contain thioether compounds, thiomorpholines, quaternary ammonium salt compounds, urethane derivatives, urea derivatives, imidazole derivatives, 3-pyrazolidone derivatives, etc.

In this invention, gelatin is advantageously used as a binder or protective colloid for the silver halide photographic emulsions but other hydrophilic colloids can be also used.

Examples of such hydrophilic colloids are cellulose derivatives such as hydroxyethyl cellulose, etc., sugar derivatives such as starch derivatives, etc., and various synthetic hydrophilic polymers including a homo- or copolymer such as polyvinyl alcohol, polyvinyl alcohol partial acetal, poly-N-vinylpyrrolidone, polyacrylic acid, polyacrylamide, etc.

As gelatin, lime-processed gelatin and acid-processed gelatin can be used, and further gelatin hydrolyzed products and gelatin enzyme decomposed products can be also used.

The silver halide photographic emulsion layer(s) and/or other hydrophilic colloid layer(s) of the photographic material of this invention may contain various kinds of surface active agents as a coating aid, for static prevention, for improving sliding property, for improving dispersion by emulsification, for preventing sticking, and for improving photographic properties (e.g., development acceleration, contrast increasing, sensitization, etc.).

Examples of the surface active agents are nonionic surface active agents such as saponin, polyoxyethylene series compounds, glycidol derivatives (e.g., polyglyceride alkenylsuccinate, etc.), fatty acid esters of polyhydric alcohols, alkyl esters, urethanes, or ethers of saccaride, etc.; anionic surface active agents such as triterpenoid series saponin, alkylcarboxylates, alkylbenzenesulfonates, alkylsulfuric acid esters, alkylphosphoric acid esters, N-acyl-N-alkyltaurines, sulfosuccinic acid esters, sulfoalkylpolyoxyethylene alkylphenyl ethers, etc.; amphoteric surface active agents such as amino acids, aminoalkylsulfonic acids, aminoalkylsulfuric acid esters, aminoalkylphosphoric acid esters, alkylbetaines, amine imides, amine oxides, etc.; and cationic surface active agents such as alkylamine salts, aliphatic or aromatic quaternary ammonium salts, heterocyclic quaternary ammonium slats (e.g., pyridiniums, imidazoliums, etc.), aliphatic or heterocyclic phosphonium or sulfonium slats, etc.

For the purpose of static prevention, fluorine-containing surface active agents are preferably used.

The photographic material of this invention may further contain a dispersion of a water-insoluble or water sparingly soluble synthetic polymer in the silver halide photographic emulsion layer(s}and/or other hydrophilic colloid layer(s) for improving the dimensional stability. Examples of such a polymer are synthetic polymers composed of alkyl (meth)acrylates, glycidyl (meth)acrylates, etc., singly or as a combination thereof or a combination of the aforesaid monomer and another monomer such as acrylic acid, methacrylic acid, etc.

Furtheremore, the photographic material of this invention may contain an inorganic or organic hardening agent in the photographic emulsion layer(s) and/or other hydrophilic colloid layer(s). Examples of the hardening agent are chromium salts, aldehydes (e.g., formaldehyde, glutar aldehyde, etc.), N-methylol compounds, active vinyl compounds (1,3,5-triacryloyl-hexahydro-S-triazine, bis(vinylsulfonyl)methyl ether, etc.), active halogen compounds (e.g., 2,4-dichloro-6-hydroxy-s-triazine, etc.), mucohalogenic acids, etc. They can be used singly or as a combination thereof.

The silver halide photographic emulsion for use in this invention is spectrally sensitized by a green sensitive region sensitizing dye represented by formula (III) or (IV) singly or as a combination thereof with a blue sensitive region sensitizing dye represented by formula (I) or (II).

The blue sensitive region sensitizing dyes for use in this invention are represented, for example, by the following formula (I) or (II):

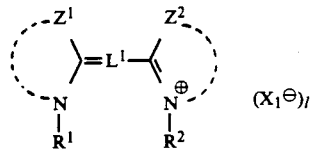

(I)

In the above formula (I), $Z^1$ and $Z^2$ each represents an atomic group necessary for forming the following nucleus.

A thiazole nucleus (e.g., thiazole, 4-methylthiazole, 4-phenylthiazole, 4,5-dimethylthiazole, 4,5-diphenylthiazole, etc.), a benzothiazole nuclues (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazle 5-phenethylbenzothiazle, 5-fluorobenzothiazole, 5-chloro-6-methylbenzothiazole, 5,6-dimethylbenzothiazole, 5-hydroxy-6-methylbenzothiazole, tetrahydrobenzo-thiazole, 4-phenylbenzothiazole, etc.), a naphthothiazole nucleus (e.g., naphtho[2,1-d]thiazole, naphtho[1,2-d]thiazole, naphtho[2,3-d]thiazole, 5-methoxynaphtho [1,2-d]thiazole, 7-ethoxynaphtho[2,1-d]-thiazole, 8-methoxynaphtho[2,1-d]thiazole, 5-methoxynaphtho[2,3-d]-thiazole, etc.), a thiazoline nucleus (e.g., thiazoline, 4-methylthiazoline, 4-nitrothiazoline, etc.), an oxazole nucleus (e.g., oxazole, 4-methyloxazole, 4-nitrooxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.) a naphthoxazole nucleus (e.g., naphth[2,1-d]oxazole, naphth[1,2-d]oxazole, naphth[2,3-d]oxazole, 5nitronaphth [2,1-d]oxazole, etc.), an oxazoline nuclues (e.g., 4,4-dimethyloxazoline, etc.), a selenazole nuclues (e.g., 4-methylselenazole, 4-nitroselenazole, 4-phenylselenazole, etc.), a benzoselenazole nucleus (e.g., benzoselenazole, 5-chlorobenzoselenazole,5-nitrobenzoselenazole, 5-methoxybenzoselenazole, 5-hydroxybenzoselenazole, 6-nitrobenzoselenazole, 5-chloro-6-nitrobenzoselenazole, etc.), a naphthoselenazole nucleus (e.g., naphtho[2,1-d]selenazole, naphtho[1,2-d]selenazole, etc.), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5 -nitroindolenine, 3,3-dimethyl-5-methoxyindolenine, 3,3,5-trimethylindolenine, 3,3-dimethyl-5 -chloroindolenine, etc.), an imidazole nucleus (e.g., 1-alkylimidazole, 1-alkyl-4-phenylimidazole, 1-alkylbenzimidazole, 1 alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5 fluorobenzimidazole, 1-alkyl-5-trifluoromethylbenzimidazole, 1-alkyl-6 -chloro5-cyanobenzimidazole, 1-alkyl-6-chloro-5-trifluoromethyl-benzimidazole, 1-alkylnaphtho[1,2-d]imidazole, 1-allyl-5.6-dichlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]-imidazole, etc.), etc.

In the above-described nuclei, the alkyl moiety can be an alkyl group preferably having from 1 to 8 carbon atoms, for example, an unsubstituted alkyl group such as a methyl group, an ethyl group, a propyl group, an isopropyl group, a butyl group, etc., and a hydroxyalkyl group (e.g., a 2-hydroxyalkyl group, a 3-hydroxypropyl group, etc.). The alkyl moiety is particularly preferably a methyl group or an ethyl group.

The aryl moiety in the aforesaid nuclei can be a phenyl group, a halogen-substituted (e.g., chlorine-substituted) phenyl group, an alkyl-substituted (e.g., methyl substituted) phenyl group, an alkoxy-substituted (e.g., methoxy-substituted) phenyl group, an oxadiazole nucleus, a thiadiazole nucleus, a tetrazole nucleus, a pyrimidine nucleus, etc.

$L^1$ in formula (I) represents a methine group or a substituted methine group (e.g. a methine group substituted by an alkyl group (e.g., methyl, ethyl, etc.), an aryl group (e.g., phenyl, etc.), or a halogen atom (e.g., chlorine, bromine, etc.)).

$R^1$ and $R^2$ in formula (I) each represents an alkyl group having from 1 to 18 carbon atoms, preferably from 1 to 7 carbon atoms, and particularly preferably from 1 to 4 carbon atoms (e.g., a methyl group, an ethyl group, a propyl group, an isopropyl group, a butyl group, an isobutyl group, a hexyl group, an octyl group, a dodecyl group, an octadecyl group, etc.), a substituted alkyl group having from 1 to 18 carbon atoms, preferably from 1 to 7 carbon atoms, and particularly preferably from 1 to 4 carbon atoms, [such as an aralkyl group (e.g., a benzyl group, a 2-phenylethyl group, etc.), a hydroxyalkyl group (e.g., a 2-hydroxyethyl group, a 3-hydroxypropyl group, etc.), a carboxyalkyl group (e.g., a 2-carboxyethyl group, a 3-carboxypropyl group, a 4-carboxybutyl group, a carboxymethyl group, etc.), an alkoxyalkyl group (e.g., a 2-methoxyethyl group, a 2-(2-methoxyethoxy)ethyl group, etc.), a sulfoalkyl group (e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group, a 3-sulfopropoxyethoxyethyl group, etc.), a sulfatoalkyl group (e.g., a 3-sulfatopropyl group, a 4-sulfatobutyl group, etc.), a heterocyclic ring-substituted alkyl group (e.g., a 2-(pyrolidine-2-one-1-yl)ethyl group, a tetrahydrofurfuryl group, etc.), a 2-acetoxyethyl group, a carbomethoxymethyl group, and a 2-methanesulfonylaminoethyl group], or an allyl group.

$X_1\ominus$ in the formula (I) represents an acid anion such as a halide anion, an alkylsulfate anion, an arylsulfonate anion, a perchlorate anion, etc.

In formula (I), l represents 0 or 1 and when the sensitizing dye of formula (I) forms an inner salt, l is 0.

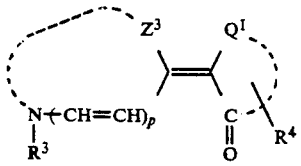

(II)

In the above formula (II), $Z^3$ represents the atomic group as defined above for $Z^1$ or $Z^2$ in formula (I) or an atomic group necessary for forming a pyridine nucleus (e.g., 2-pyridine, 4-pyridine, 5-methyl-2-pyridine, 3-methyl-4-pyridine, etc.).

$R^3$ in formula (II) has the same significance as $R^1$ or $R^2$ in formula (I).

$Q^1$ in formula (II) represents a non-metallic atom group necessary for forming a 5-membered or 6-membered nitrogen-containing heterocyclic ring such as a rhodanine nucleus, 2-thiohydantoin nucleus, a 2-thioxooxazolidine-4-one nucleus, a 2-pyrazoline-5-one nucleus, a barbituric acid nucleus, a 2-thiobarbituric acid nucleus, a thiazolidine-2,4-dione nucleus, a thiazolidine-4-one nucleus, an isoxazolone nucleus, a hydantoin nucleus, an indandione nucleus, etc.

$R^4$ in formula (II) is bonded to the nitrogen atom contained in the aforesaid nucleus and represents a hydrogen atom, an alkyl group having from 1 to 18 carbon atoms, preferably from 1 to 7 carbon atoms, and particularly preferably from 1 to 4 carbon atoms (e.g., a methyl group, an ethyl group, a propyl group, an isopropyl group, a butyl group, an isobutyl group, a hexyl group, an octyl group, a dodecyl group, an octadecyl group, etc.), a substituted alkyl group having from 1 to 18 carbon atoms, preferably from 1 to 7 carbon atoms, and particularly preferably from 1 to 4 carbon atoms [such as an aralkyl group (e.g., a benzyl group, a 2-phenylethyl group, etc.), a hydroxyalkyl group (e.g., a 2-hydroxyethyl group, a 3-hydroxypropyl group, etc.), a carboxyalkyl group (e.g., a 2-carboxyethyl group, a 3-carboxypropyl group, a 4-carboxybutyl group, a carboxymethyl group, etc.), an alkoxyalkyl group (e.g., a 2-methoxyethyl group, a 2-(2-methoxyethoxy)ethyl group, etc.), a sulfoalkyl group (e.g., a 2-sulfoethyl group, a 3-sulfopropyl group, a 3-sulfobutyl group, a 4-sulfobutyl group, a 2-(3-sulfopropoxy)ethyl group, a 2-hydroxy-3-sulfoporpyl group, a 3-sulfopropoxyethoxyethyl group, etc.), a sulfatoalkyl group (e.g., a 3-sulfatopropyl group, a 4-sulfatobutyl group, etc.), a heterocyclic ring-substituted alkyl group (e.g., a 2-(pyrrolidine-2-one-1-yl)ethyl group, a tetrahydrofurfuryl group, a 2-morpholinoethyl group, etc.), a 2-acetoxyethyl group, a carbomethoxymethyl group, a 2-methanesulfonylaminoethyl group, etc.], an allyl group, an aryl group (e.g., a phenyl group, a 2-naphthyl group, etc.), a substituted aryl group (e.g., a 4-carboxyphenyl group, a 4-sulfophenyl group, a 3-chlorophenyl group, a 3-methylphenyl group, etc.), or a heterocyclic group (e.g., a 2-pyridyl group, a 2-thiazolyl group, etc.).

In formula (II), p represents 0 or 1.

Specific examples of the blue sensitive region sensitizing dyes shown by formulae (I) and (II) for use in this invention are illustrated below but the invention is not limited thereto.

B-1

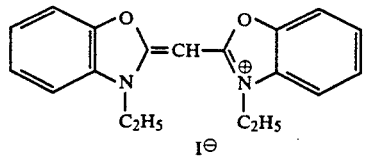

B-2

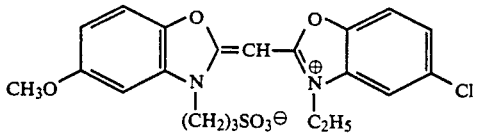

-continued
B-3
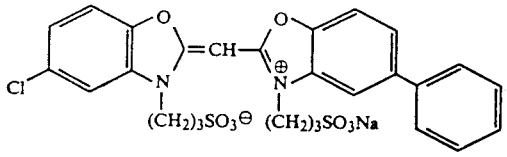
B-4
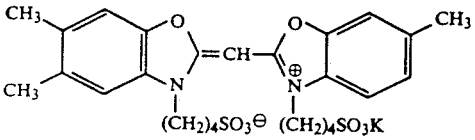
B-5
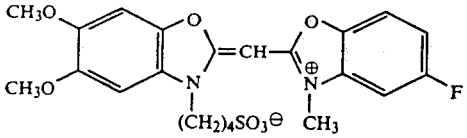
B-6
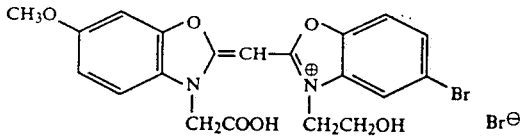
B-7
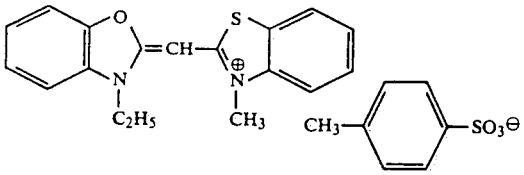
B-8
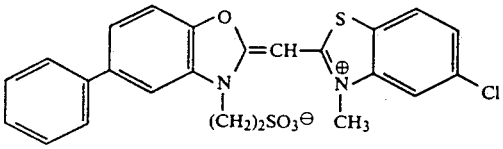
B-9
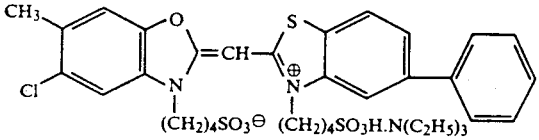
B-10
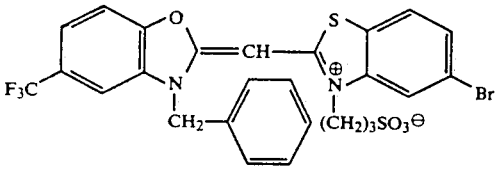
B-11
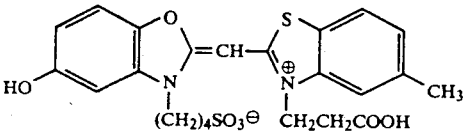
B-12
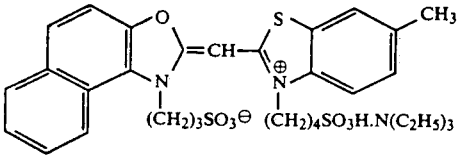
-continued
B-13
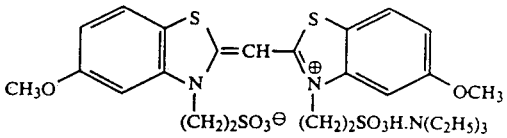
B-14
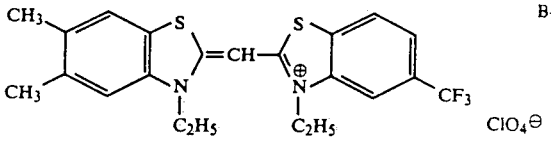
B-15
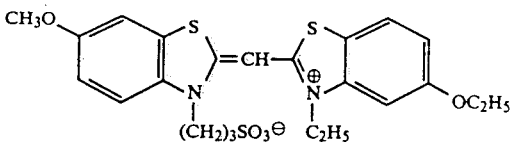
B-16
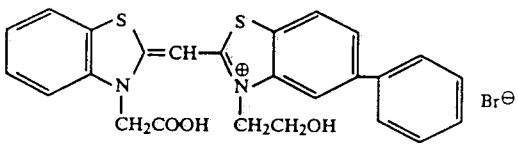
B-17
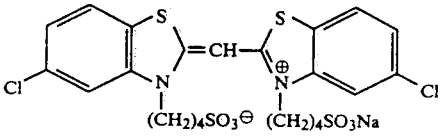
B-18
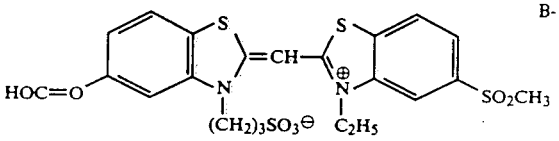
B-19
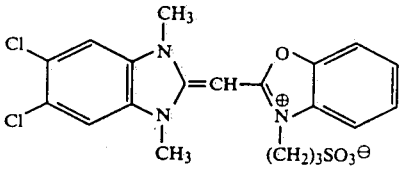
B-20
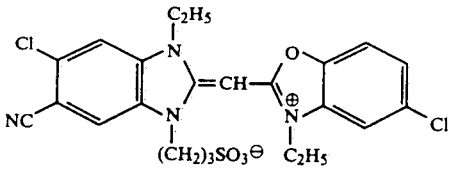
B-21
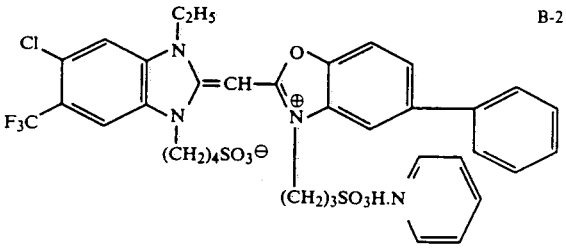

-continued

B-22

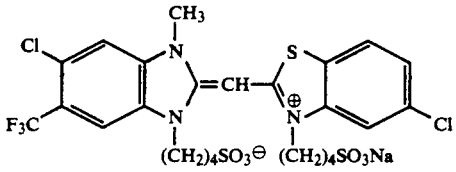

B-23

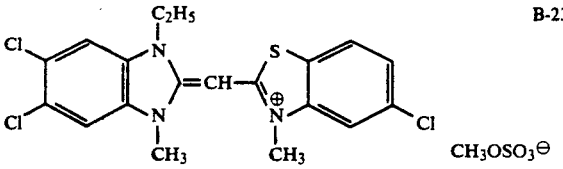

B-24

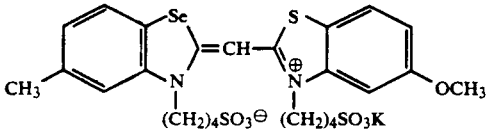

B-25

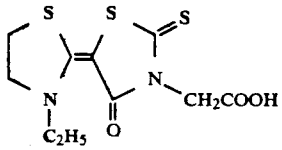

B-26

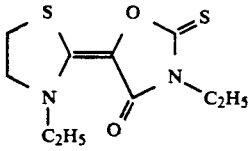

B-27

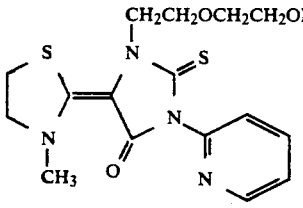

B-28

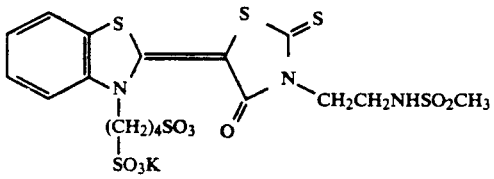

B-29

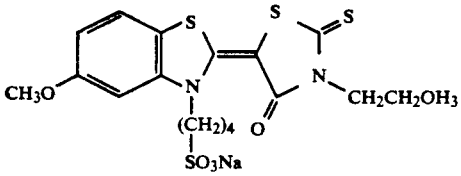

B-30

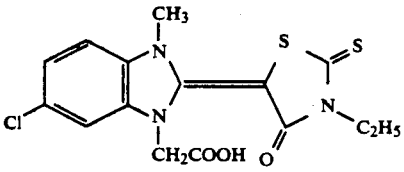

-continued

B-31

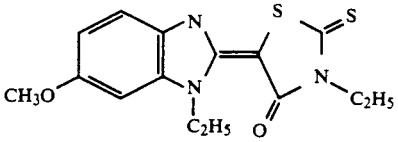

B-32

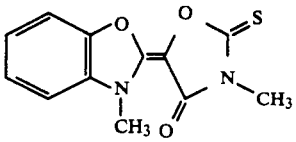

B-33

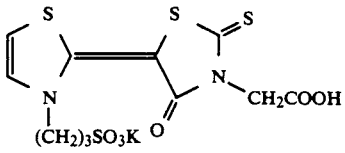

B-34

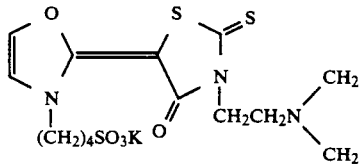

B-35

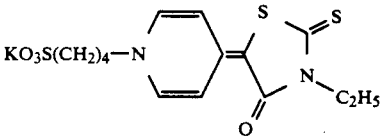

B-36

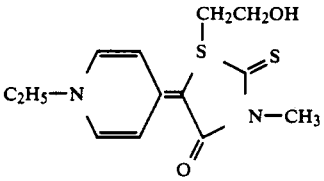

The green sensitive region sensitizing dyes for use in this invention are shown by, for example, following formula (III) or (IV):

(III)

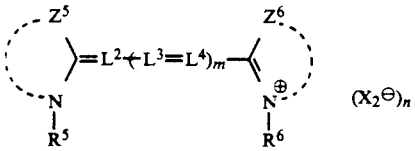

In the above formula (III), $Z^5$ and $Z^6$ each represents an atomic group necessary for forming the following nucleus.

A thiazole nucleus (e.g., thiazole, 4-methylthiazole, 4-phenylthiazole, 4,5-dimethylthiazole, 4,5-diphenylthiazole, etc.), a benzothiazole nuclues (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazle, 5-phenethylbenzothiazle, 5-fluorobenzothiazole, 5-chloro-6-methylbenzothiazole, 5,6-dimethylbenzothiazole, 5-hydroxy-6-methylbenzothiazole, tetrahydrobenzothiazole, 4-phenylbenzothiazole, etc.), a naphthothiazole nucleus (e.g., naphtho[2,1 d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]-thiazole, 5-methoxynaphtho[2,3-d]thiazole, etc.), a thiazoline nucleus (e.g., thiazoline, 4-methylthiazoline, 4-nitrothiazoline, etc.), an oxazole nucleus (e.g., oxazole, 4-methyloxazole, 4-nitrooxazole, 5-methyloxazole, 4-phenyloxazole, 4,5-diphenyloxazole, 4-ethyloxazole, etc.), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, etc.), a naphthoxazole nucleus (e.g., naphth[2,1-d]oxazole, naphth[1,2-d]oxazole, naphth[2,3-d]oxazole, 5-nitronaphth[2,1-d]oxazole, etc.), an oxazoline nuclues (e.g., 4,4-dimethyloxazoline, etc.), a selenazole nuclues (e.g., 4-methylselenazole, 4-nitroselenazole, 4-phenylselenazole, etc.), a benzoselenazole nucleus (e.g., benzoselenazole, 5-chlorobenzoselenazole,5-nitrobenzoselenazole, 5-methoxy benzoselenazole, 5-hydroxybenzoselenazole, 6-nitrobenzoselenazole, 5-chloro-6-nitrobenzoselenazole, etc.), a naphthoselenazole nucleus (e.g., naphtho[2,1-d]selenazole., naphtho[1,2-d]selenazole, etc.), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, 3,3-dimethyl-5 chloroindolenine, etc.), an imidazole nucleus (e.g., 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole 1-alkyl-6chloro-5cyanobenzimidazole, 1-alkyl-6-chloro-5-trifluoromethylbenzimidazole, 1-alkylnaphtho [1,2-d]imidazole, 1-allyl-5.6-dichloro-benzimidazole, 1-arylimidazole, 1-arylbenzimidazole, 1-aryl-5-chlorobenzimidazole, 1-aryl-5,6-dichlorobenzimidazole, 1-5-methoxybenzimidazole, 1-aryl-5-cyanobenzimidazole, 1-arylnaphtho[1,2-d]imidazole, etc.), etc.

In the above-described nuclei, the alkyl moiety can be an alkyl group preferably having from 1 to 8 carbon atoms, for example, an unsubstituted alkyl group such as a methyl group, an ethyl group, a propyl group, an isopropyl group, a butyl group, etc., and a hydroxyalkyl group (e.g., a 2-hydroxyalkyl group, a 3-hydroxypropyl group, etc ). The alkyl moiety is particularly preferably a methyl group or an ethyl group.

The aryl moiety in the aforesaid nuclei can be a phenyl group, a halogen-substituted (e.g., chlorine-substituted) phenyl group, an alkyl-substituted (e.g., methyl-substituted) phenyl group, an alkoxy-substituted (e.g., methoxy-substituted) phenyl group, a 2-pyridine nucleus (e.g., 2-pyridine, 5-methyl-2-pyridine, etc.,), a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-6-hydroxy-2-quinoline, 6-hydroxy-2-quinoline, 8-chloro-2-quinoline, etc.), an oxadiazole nucleus, a thiadiazole nucleus, a tetrazole nucleus, a pyrimidine nucleus, etc.

In the combinations of $Z^5$ and $Z^6$, however, the following combinations are excluded.

| |
|---|
| Oxazole nucleus and thiazole nucleus |
| Oxazole nucleus and benzothiazole nucleus |
| Oxazole nucleus and naphthothiazole nucleus |
| Oxazole nucleus and selenazole nucleus |
| Oxazole nucleus and benzoselenazole nucleus |
| Oxazole nucleus and naphthoselenazole nucleus |
| Oxazole nucleus and 3,3-dialkylindolenine nucleus |
| Benzoxazole nucleus and thiazole nucleus |
| Benzoxazole nucleus and benzothiazole nucleus |
| Benzoxazole nucleus and naphthothiazole nucleus |
| Benzoxazole nucleus and selenazole nucleus |
| Benzoxazole nucleus and benzoselenazole nucleus |
| Benzoxazole nucleus and naphthoselenazole nucleus |
| Benzoxazole nucleus and 3,3-dialkylindolenine nucleus |
| Naphthoxazole nucleus and naphthoxazole nuclues |
| Naphthoxazole nucleus and thiazole nuclues |
| Naphthoxazole nucleus and benzothiazole nucleus |
| Naphthoxazole nucleus and naphthothiazole nucleus |
| Naphthoxazole nucleus and selenazole nucleus |
| Naphthoxazole nucleus and benzoselenazole nucleus |
| Naphthoxazole nucleus and naphthoselenazole nucleus |
| Naphthoxazole nucleus and 3,3-dialkylindolenine nucleus |
| Naphthoxazole nucleus and naphthimidazole nuclues |
| Imidazole nucleus and thiazole nucleus |
| Imidazole nucleus and benzothiazole nucleus |
| Imidazole nucleus and naphthothiazole nucleus |
| Imidazole nucleus and selenazoel nucleus |
| Imidazole nucleus and benzoselenazole nucleus |
| Imidazole nucleus and naphthoselenazole nucleus |
| Imidazole nucleus and 3,3-dialkylindolenine nucleus |
| Imidazole nucleus and imidazole nucleus |
| Imidazole nucleus and benzimidazole nucleus |
| Imidazole nucleus and naphthimidazole nucleus |
| Benzimidazole nucleus and thiazole nucleus |
| Benzimidazole nucleus and benzothiazole nucleus |
| Benzimidazole nucleus and naphthothiazole nucleus |
| Benzimidazole nucleus and selenazole nucleus |
| Benzimidazole nucleus and benzoselenazole nucleus |
| Benzimidazole nucleus and naphthoselenazole nuclues |
| Benzimidazole nucleus and 3,3-dialkylindolenine nucleus |
| Benzimidazole nucleus and imidazole nucleus |
| Benzimidazole nucleus and benzimidazole nucleus |
| Benzimidazole nucleus and naphthimidazole nucleus |
| Naphthimidazole nucleus and thiazole nucleus |
| Naphthimidazole nucleus and benzothiazole nucleus |
| Naphthimidazole nucleus and naphthothiazole nucleus |
| Naphthimidazole nucleus and selenazole nucleus |
| Naphthimidazole nucleus and benzoselenazole nucleus |
| Naphthimidazole nucleus and naphthoselenazole nucleus |
| Naphthimidazole nucleus and 3,3-dialkylindolenine nucleus |
| Thiazole nuclues and thiazole nucleus |
| Thiazole nuclues and benzothiazole nucleus |
| Thiazole nuclues and naphthothiazole nucleus |
| Thiazole nuclues and selenazole nucleus |
| Thiazole nuclues and benzoselenazole nucleus |
| Thiazole nuclues and naphthoselenazole nucleus |
| Thiazole nuclues and 3,3-dialkylindolenine nucleus |
| Benzothiazole nucleus and benzothiazole nucleus |
| Benzothiazole nucleus and naphthothiazole nucleus |
| Benzothiazole nucleus and selenazole nucleus |
| Benzothiazole nucleus and benzoselenazole nucleus |
| Benzothiazole nucleus and naphthoselenazole nucleus |
| Benzothiazole nucleus and 3,3-dialkylindolenine nucleus |
| Naphthothiazole nucleus and naphthothiazole nucleus |
| Naphthothiazole nucleus and selenazole nucleus |
| Naphthothiazole nucleus and benzoselenazole nucleus |
| Naphthothiazole nucleus and naphthoselenazole nucleus |
| Naphthothiazole nucleus and 3,3-dialkylindolenine nucleus |
| Selenazole nucleus and selenazole nucleus |
| Selenazole nucleus and benzoselenazole nucleus |
| Selenazole nucleus and naphthoselenazole nucleus |
| Selenazole nucleus 3,3-dialkylindolenine nucleus |
| Benzoselenazole nucleus and benzoselenazole nucleus |
| Benzoselenazole nucleus and naphthoselenazole nucleus |
| Benzoselenazole nucleus and 3,3-dialkylindolenine nucleus |
| Naphthoselenazole nucleus and naphthoselenazole nucleus |
| Naphthoselenazole nucleus and 3,3-dialkylindolenine nucleus |

-continued

| |
|---|
| 3,3-Dialkylindolenine nucleus and 3,3-dialkylindolenine nucleus |
| 2-Quinoline nucleus and 2-quinoline nucleus. |

In formula (III), $R^5$ and $R^6$ have the same significance as $R^1$ or $R^2$ in formula (I) described above, $L^2$, $L^3$, and $L^4$ have the same significance as $L^1$ in formula (I) described above and $X_2\ominus$ has the same significance as $X_1\ominus$ in formula (I).

Also, in formula (III), n has the same significance as l in formula (I) described above, and m represents 0 when one of $Z^5$ and $Z^6$ is a 2-quinoline nucleus and represents 1 in other cases.

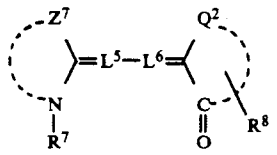

(IV)

In the above formula (IV), $Z^7$ represents an atomic group necessary for forming each of the nuclei as defined above in regard tO $Z^1$ in formula (I) excluding the following nuclei: a selenazole nucleus, a benzoselenazole nucleus, a naphthoselenazole nucleus, a naphthothiazole nucleus, and naphthimidazole nucleus.

In formula (IV), $Q^2$ has the same significance as $Q^1$in formula (II) described above. However, the following combinations are excluded from the combinations of $Z^7$ and $Q^2$ in formula (IV):

-continued

| |
|---|
| Thiazole nucleus and rhodanine nucleus |
| Thiazole nucleus and 2-thiohydantoin nucleus |
| Thiazole nucleus and 2-pyrazoline-5-one nucleus |
| Thiazole nucleus and barbituric acid nucleus |
| Thiazole nucleus and thiobarbituric acid nucleus |
| Thiazole nucleus and thiazolidine-2,4-dione nucleus |
| Thiazole nucleus and thiazolidine-4-one nucleus |
| Thiazole nucleus and hydantoin nucleus |
| Thiazole nucleus and indandinone nucleus |
| Benzothiazole nucleus and rhodanine nucleus |
| Benzothiazole nucleus and 2-thiohydantoin nucleus |
| Benzothiazole nucleus and 2-pyrazoline-5-one nucleus |
| Benzothiazole nucleus and barbituric acid nucleus |
| Benzothiazole nucleus and thiobarbituric acid nucleus |
| Benzothiazole nucleus and thiazolidine-2,4-dione nucleus |
| Benzothiazole nucleus and thiazolidine-4-one nucleus |
| Benzothiazole nucleus and hydantoin nucleus |
| Benzothiazole nucleus and indandiaone nucleus |
| Naphthothiazole nucleus and rhodanine nucleus |
| Naphthothiazole nucleus and 2-thiohydanoin nucleus |
| Naphthothiazole nucleus and 2-pyrazoline-5-one nucleus |
| Naphthothiazole nucleus and barbituric acid nucleus |
| Naphthothiazole nucleus and thiobarbituric acid nucleus |
| Naphthothiazole nucleus and thiazolidine-2,4-dione nucleus |
| Naphthothiazole nucleus and thiazolidine-4-one nucleus |
| Naphthothiazole nucleus and hydantoin nucleus |
| Naphthothiazole nucleus and indandione nucleus |
| Imidazole nucleus and rhodanine nucleus |
| Imidazole nucleus and 2-thiohydantoin nucleus |
| Imidazole nucleus and 2-pyrazoline-5 one nucleus |
| Imidazole nucleus and barbituric acid nucleus |
| Imidazole nucleus and thiobarbituric acid nucleus |
| Imidazole nucleus and thiazolidine-2,4-dione nucleus |
| Imidazole nucleus and thiazolidine-4-one nucleus |
| Imidazole nucleus and hydantoin nucleus |
| Imidazole nucleus and indandione nucleus |
| Benzimidazole nucleus and rhodanine nucleus |
| Benzimidazole nucleus and 2-thiohydantoin nucleus |
| Benzimidazole nucleus and 2-pyrazoline-5-one nucleus |
| Benzimidazole nucleus and barbituric acid nucleus |
| Benzimidazole nucleus and thiobarbituric acid nucleus |
| Benzimidazole nucleus and thiazolidine-2,4-dione nucleus |
| Benzimidazole nucleus and thiazolidine-4-one nucleus |
| Benzimidazole nucleus and hydantoin nucleus |
| Benzimidazole nucleus and indandione nucleus |
| Naphthimidazole nucleus and rhodanine nucleus |
| Naphthimidazole nucleus and 2-thiohydantoin nucleus |
| Naphthimidazole nucleus and 2-pyrazoline-5-one nucleus |
| Naphthimidazole nucleus and barbituric acid nucleus |
| Naphthimidazole nucleus and thiobarbituric acid nucleus |
| Naphthimidazole nucleus and thiazolidine-2,4-dione nucleus |
| Naphthimidazole nucleus and thiazolidine-4-one nucleus |
| Naphthimidazole nucleus and hydantoin nucleus |
| Naphthimidazole nucleus and indandione nucleus |
| 3,3-dialkylindolenine nucleus and rhodanine nucleus |
| 3,3-dialkylindolenine nucleus and 2-thiohydantoin nucleus |
| 3,3-dialkylindolenine nucleus and 2-pyrazoline-5-one nucleus |
| 3,3-dialkylindolenine nucleus and barbituric acid nucleus |
| 3,3-dialkylindolenine nucleus and thiobarbituric acid nucleus |
| 3,3-Dialkylindolenine nucleus and thiazolidine-2,4-dione nucleus |
| 3,3-Dialkylindolenine nucleus and thiazolidine-4-one nucleus |
| 3,3-Dialkylindolenine nucleus and hydantoin nucleus |
| 3,3-Dialkylindolenine nucleus and indandione nucleus |

In formula (IV), $R^7$ has the same significance as $R^1$ or $R^2$ in formula (I) described above, $R^8$ has the same significance as $R^4$ in formula (II) described above, and $L^5$ and $L^6$ have the same significance as $L^1$ in formula (I) described above.

Specific examples of the green sensitive region sensitizing dyes shown by formulae (III) and (IV) for use in this invention are illustrated below but the invention is not limited to these compounds.

G-1

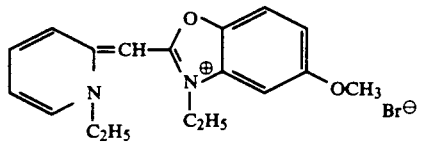

G-2

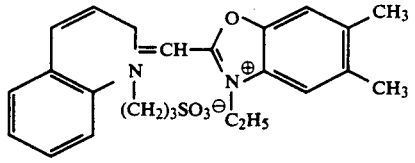

-continued
G-13
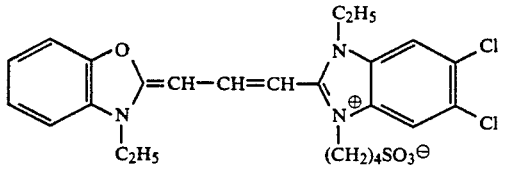
G-14
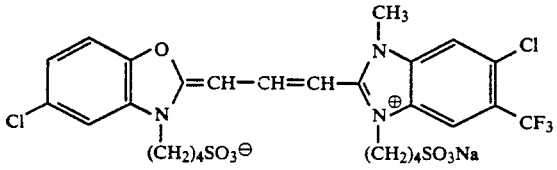
G-15
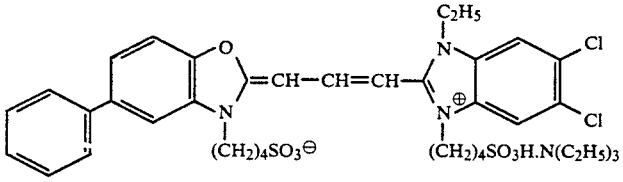
G-16
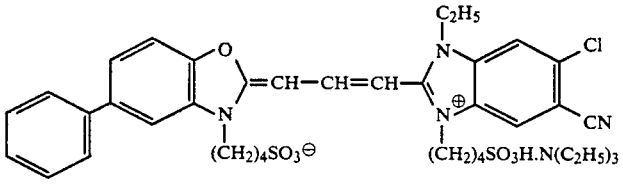
G-17
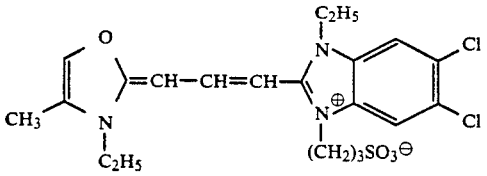
G-18
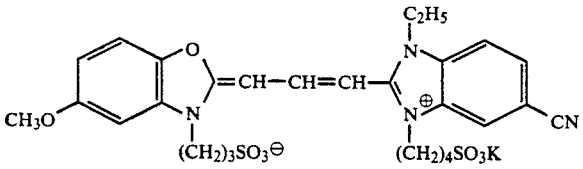
G-19
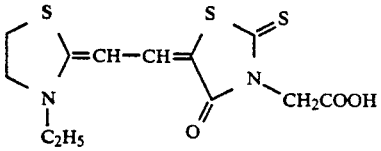
G-20
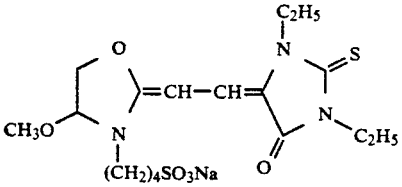

-continued
G-21
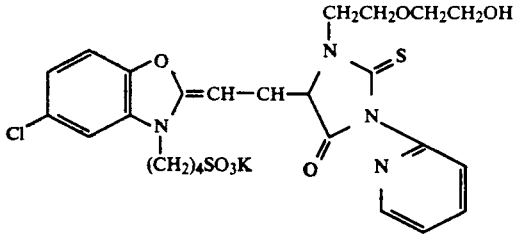
G-22
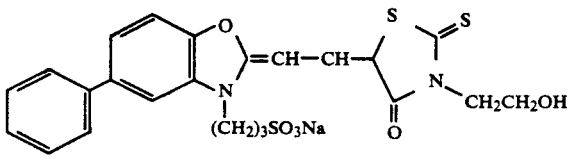
G-23
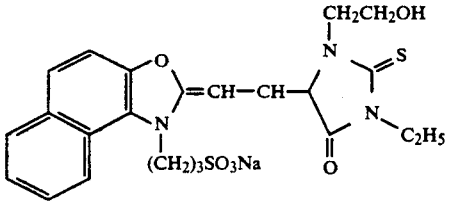
G-24
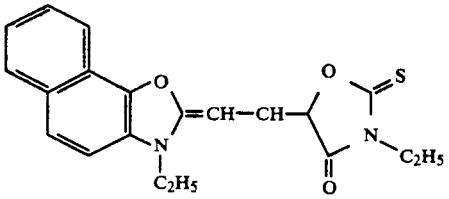
G-25
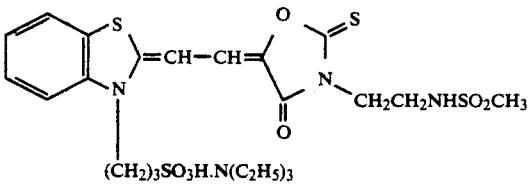
G-26
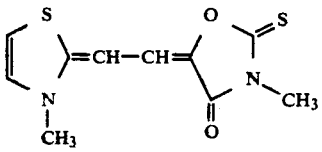
G-27
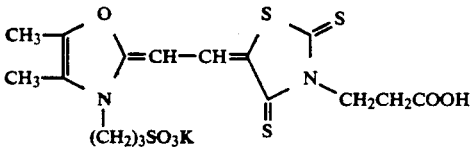
G-28
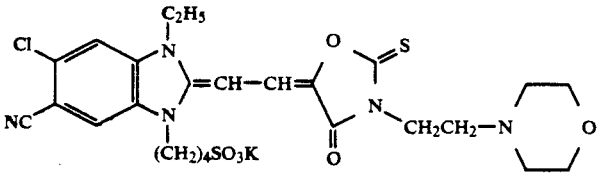

-continued

G-29

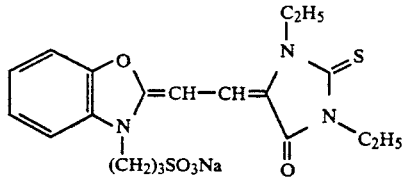

G-30

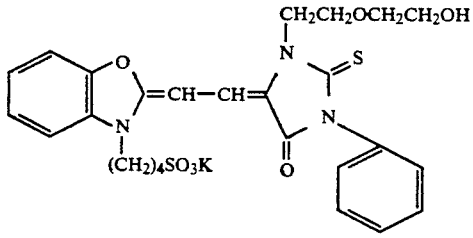

The addition amount of the sensitizing dye(s) differs according to the desired purposes and the degree of spectral sensitization but is from $10^{-6}$ to $10^{-2}$ mol, preferably from $10^{-5}$ to $10^{-3}$ mol per mol of silver of the silver halide emulsion. The sensitizing dye(s) may be added to the silver halide emulsion at any step of the formation of silver halide grains, washing of the emulsion, and before, during, or after chemical sensitization of the emulsion.

The sensitizing dyes may be used singly or as a combination thereof.

The photographic material of this invention may further contain water-soluble dyes (oxonole dyes, hemioxonole dyes, styrene dyes, merocyanine dyes, cyanine dyes, azo dyes, etc.) in the hydrophilic colloid layer(s) as filter dyes, irradiation preventing dyes, or other various purposes.

The silver halide photographic materials of this invention may contain known toning agents, antifoggants, or stabilizers. As such toning agents, antifoggants, or stabilizers which can be used in this invention, there are, for example, mercaptos, benzothiazolium salts, nitroindazoles, nitrobenzimidazoles, chlorobenzimidazoles, bromobenzimidazoles, aminotriazoles, benzotriazoles, nitrobenztriazoles, benzenethiosulfonic acids, benzenesulfinic acids, benzenesulfonic acid amide, azaindenes (e.g., triazaindenes, tetraazaindenes (in particular, 4-hydroxy-substituted (1,3,3a,7)tetraazaindenes)), etc.

The preferred toning agent is a compound having a sulfur atom such as this group and mercapto group. It is more preferred that the photographic material of this invention contains a compound having a sulfur atom as a toning agent in an amount of from $2\times10^{-4}$ to $2\times10^{-2}$ per mol of the silver halide.

The light exposure for obtaining photographic images using the photographic material of this invention may be performed by an ordinary manner.

The exposure time is usually from 1/10 sec. to 100 sec., which is used for an enlarger. However, an exposure time of shorter than 1/10 sec., for example, from $1/10^4$ to $1/10^6$ sec, in the case of using a xenon flash lamp or a cathode ray tube can be used or an exposure time longer than 100 sec. may be used. The preferred exposure time is from ¼ sec. to 100 sec in view of the exposure precision of the enlarger.

In the photographic materials of this invention, it is preferred that silver images obtained in the case of changing the color filter during exposure do not substantially change in gradation. This is important in the case of printing a developed transparent color photographic material and the aforesaid condition is necessary for reproducing the same tone even when the color of the transparent color photographic material is changed. In general, the developed transparent color photographic material is colored in yellow, magenta and cyan.

For producing the photographic material as described above, the following methods are used.

(1) In the case of using a single silver halide emulsion, the sensitizing dyes for use may be used singly or as a mixture thereof and the dye(s) may be added to the emulsion at any step of from the formation of the silver halide grains of the silver halide emulsion to directly before coating.

(2) In the case of using plural silver halide emulsions as a mixture thereof, if the sensitizing dye(s) being added to each silver halide emulsion have the same or substantially same spectral sensitizing region (the peak wavelength is not longer than 30 nm), the sensitizing dye(s) may be added to the silver halide emulsion at any step of from the formation of the silver halide grains of the silver halide emulsion to directly before coating. Also, in the case of adding these sensitizing dyes after mixing the silver halide emulsions, the sensitizing dyes may be added thereto at any step of from the mixing step thereof to coating.

(3) In the case of coating plural silver halide emulsions in separate layers, it is preferred that the sensitizing dye(s) being added to each silver halide emulsion have the same or substantially same spectral sensitizing region (the peak wavelength is not longer than 30 nm), and the sensitizing dye(s) may be added to each emulsion at any step of from the formation of the silver halide grains of the emulsion to directly before coating.

The photographic material of the invention is preferably provided with writability.

For processing the photographic materials of this invention, any development processing method for forming silver images can be used.

The invention is explained in more detail by the following nonlimiting examples. In the following examples, all parts and percents are by weight unless indicated otherwise.

EXAMPLE 1

(1) Preparation of Light-Sensitive Silver Halide Emulsion:

An aqueous solution of potassium bromide and sodium chloride and an aqueous solution of silver nitrate were added to an aqueous gelatin solution in acid state (pH=4) by a double jet method with vigorously stirring to provide a monodispersed cubic silver halide emulsion (silver bromide 50 mol %, dispersion coefficient 14%) having a means grain size of 0.4 μm. Thereafter, the emulsion was washed with water by an ordinary precipitation method and then sulfur-sensitized to provide light-sensitive silver chlorobromide emulsion A.

(2) Preparation of Coated Samples:

Each of Samples 1 to 9 was prepared by coating, in succession, the layers having the following compositions on a paper support thickness of 200 μm) having polyethylene coating on both surfaces thereof.

| | |
|---|---|
| Emulsion Layer | |
| Binder: Gelatin | 4.7 g/m$^2$ |
| Silver Coverage: | 1.5 g/m$^2$ |
| Sensitizing Dyes: Described in Table 1 below | |
| Coating Aid: Sodium dodecylbenzenesulfonate | 7 mg/m$^2$ |
| Fluorescent Whitening Agent having the formula: | 0.1 g/m$^2$ |

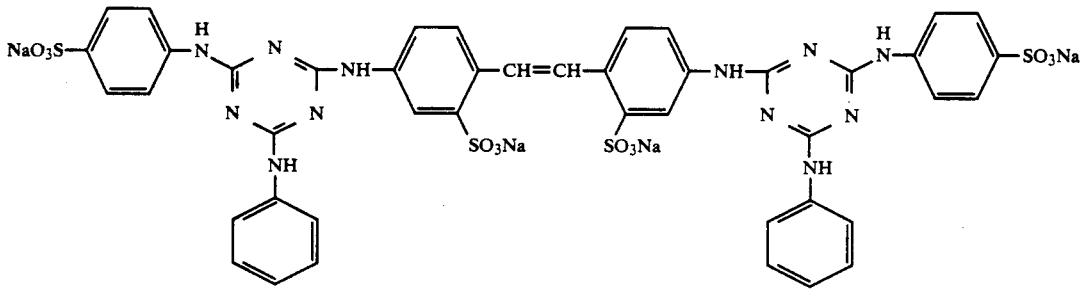

| | |
|---|---|
| Polymer Latex: Polyethyl acrylate | 2 g/m$^2$ |
| Toning Agent: shown below: | |

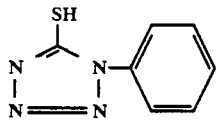

4.5 mg/m$^2$

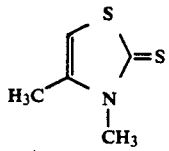

0.4 mg/m$^2$

| | |
|---|---|
| Surface Protective Layer | |
| Binder: Gelatin | 2.0 g/m$^2$ |
| Coating Aid: Sodium dodecylbenzenesulfonate | 80 mg/m$^2$ |
| Colloidal Silica (average size: 0.05 μm) | 0.3 g/m$^2$ |
| Hardening Agent: 4-Dichloro-6-hydroxy-1,3,5-triazine Sodium Salt | 0.08 g/m$^2$ |

(3) Sensitometry:

Each of the samples was stored for 7 days after coating under the conditions of 25° C. and 65% RH and evaluated as described below. The results of the photographic performance obtained are shown in Table 1.

(A) Evaluation of Image Quality

A color negative image obtained by processing a negative color photographic film, super HR400 (trade name, made by Fuji Photo Film Co.) was printed on each of the samples, the sample was developed using a developer formed by diluting Fuji Papitol Developer (trade name, made by Fuji Photo Film Co.) with water at 1:1 for 90 seconds at 20° C., stopped, fixed using Fuji Fijix (tradename, made by Fuji Photo Film Co.) for 5 minutes, washed, and dried. Thereafter, the image qualities (graininess and sharpness) were evaluated as follows.

O: Permissible level for practically use

X: Level causing trouble for practical use

(B) Safelight Safety

After vertically placing Samples 1 to 9 under a safelight obtained by applying Fuji Safelight Filter No. 6 (trade name, made by Fuji Photo Film Co.) to a tungsten lamp of 100 V-20 W at a distance of 1 meter therefrom for 10 minutes, the samples were developed stopped, fixed, washed and dried as above and the formation of fog was evaluated as follows.

O: Fog not formed.

X: Fog formed to an extent of causing trouble for practical use.

(C) Evaluation of Sensitivity

After exposing each sample through a continuous wedge to a tungsten light of 2854K, 400 lux for one second, the sample was developed, stopped, fixed, and dried as in the case of Evaluation (A), and then the photographic sensitivity thereof was evaluated as the value of the exposure amount H (lux x second) giving an optical density, fog +0.6 divided by 1,000.

(1) Sensitivity (I)

The sensitivity in the case of exposing without using filter.

(2) Sensitivity (II)

The sensitivity in the case of exposing through Sharp Cut Filter SC 52 (trade name, made by Fuji Photo Film Co.).

(3) Sensitivity (III)

The sensitivity in the case of exposing through Sharp Cut Filter SC-62 (trade name, made by Fuji Photo Film Co.).

$$\text{Relative Sensitivity } (A) = \frac{\text{Sensitivity (II)}}{\text{Sensitivity (I)}}$$

$$\text{Relative Sensitivity } (B) = \frac{\text{Sensitivity (III)}}{\text{Sensitivity (I)}}$$

The results are shown in Table 1 below.

As is clear from the results shown in Table 1 above, only the samples having a Relative Sensitivity (A) of at least 1/18 and a Relative Sensitivity (B) of not more than 1/30 were photographic materials having good image qualities (both graininess and sharpness) and excellent safelight safety.

EXAMPLE 2

(1) Preparation of Light-Sensitive Silver Halide Emulsion

Light-sensitive silver bromide emulsion A as shown in Example 1 and a monodispersed cubic silver chlorobromide emulsion B (silver bromide 50 mol %, dispersion coefficient 12%) having a mean grain size of 0.5 μm formed by controlling the temperature at the formation of silver halide grains in the case of preparing Emulsion A were prepared (2) Preparation of Coated Samples Each of coated samples 10 to 13 was prepared by forming, in succession, the layers having the following compositions on a paper support (thickness 220 μm) having polyethylene coatings on both of the surfaces thereof

| Emulsion Layer | |
|---|---|
| Binder: Gelatin | 5.4 g/m$^2$ |
| Silver Coverage: Emulsion A + Emulsion B | 1.5 g/m$^2$ |

TABLE 1

| Sample | Sensitizing dye B | Sensitizing dye G | Sensitizing dye R | Image quality: Graininess | Image quality: Sharpness | Safe light safety | Relative Sensitivity (A) | Relative Sensitivity (B) |
|---|---|---|---|---|---|---|---|---|
| 1 (comparative example) | — | — | — | X | O | O | 1/100 or less | 1/100 or less |
| 2 (comparative example) | B-35 (38 mg/Ag-mol) | — | — | X | O | O | 1/100 or less | 1/100 or less |
| 3 (Invention) | B-35 (38 mg/Ag-mol) | G-19 (46 mg/Ag-mol) | — | O | O | O | 0.17 | 1/100 or less |
| 4 (Comparative example) | B-35 (38 mg/Ag-mol) | G-19 (46 mg/Ag-mol) | R-1 (46 mg/Ag-mol) | O | X | X | 0.20 | 0.37 |
| 5 (Comparative example) | — | — | R-1 (46 mg/Ag-mol) | X | X | X | 0.14 | 0.42 |
| 6 (Invention) | — | G-19 (46 mg/Ag-mol) | — | O | O | O | 0.31 | 1/100 or less |
| 7 (Invention) | — | G-5 (46 mg/Ag-mol) | — | O | O | O | 0.45 | 1/100 or less |
| 8 (Comparative example) | — | G-19 (46 mg/Ag-mol) | R-1 (46 mg/Ag-mol) | O | X | X | 0.49 | 0.43 |
| 9 (Comparative example) | — | — | R-1 (46 mg/Ag-mol) | O | X | X | 0.18 | 0.47 |

R-1

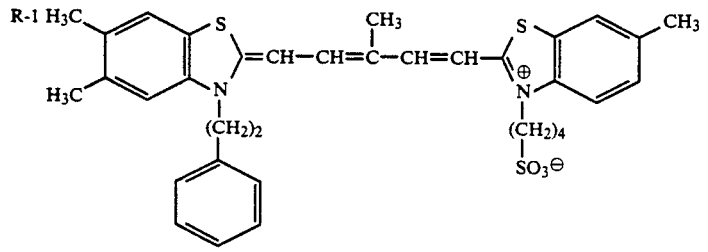

-continued

| | |
|---|---|
| (mixing ratio 1:1) | |
| Sensitizing Dyes: As shown in Table 2 below | |
| Coating Aid: Sodium dodecylbenzene-sulfonate | 7 mg/m$^2$ |
| Fluorescent Whitening Agent (same as Example 1) | 0.1 g/m$^2$ |
| Polymer Latex: Polyethyl acrylate | 2 g/m$^2$ |
| Toning Agent: shown below: | |
| 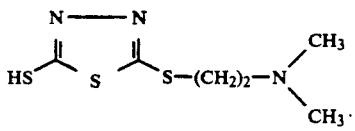 | 5.6 mg/m$^2$ |
| 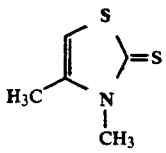 | 0.4 mg/m$^2$ |
| Surface Protective Layer | |
| Binder: Gelatin | 2.0 g/m$^2$ |
| Coating Aid: Sodium dodecylbenzene-sulfonate | 80 mg/m$^2$ |
| Matting Aid: Thyloid 79 ($SiO_2$, mean size 3 m) (trade name, Fuji Livison K. K.) | 0.15 g/m$^2$ |
| Hardening Agent: 4-Dichloro-6-hydroxy-1,3,5-triazine sodium salt | 0.08 g/m$^2$ |

(3) Sensitometry

Same as Example 1.

These samples were evaluated in the same manner as in Example 1 and the results obtained are shown in Table 2 below.

TABLE 2

| Sample | Sensitizing dye B | Sensitizing dye G | Sensitizing dye R | Image quality: Graininess | Image quality: Sharpness | Safe light safety | Relative Sensitivity A | Relative Sensitivity B |
|---|---|---|---|---|---|---|---|---|
| 10 (comparative example) | — | — | — | X | O | O | 1/100 or less | 1/100 or less |
| 11 (comparative example) | B-35 (60 mg/Ag-mol) | — | — | X | O | O | 0.01 | 1/100 or less |
| 12 (Invention) | — | G-19 (60 mg/Ag-mol) | — | O | O | O | 0.40 | 1/100 or less |
| 13 (Comparative example) | — | — | R-1 (60 mg/Ag-mol) | O | X | X | 0.22 | 0.56 |

As is clear from the results shown in Table 2, the sample having a Relative Sensitivity (A) of at least 1/10 and a Relative Sensitivity (B) of not more than 1/30 is the photographic material having good image qualities (both the graininess and sharpness) and excellent safelight safety.

In this case, the color negative used for the evaluation was an aviation photograph.

While the invention has been described in detail and with reference to specific embodiments thereof, it will be apparent to one skilled in the art that various changes and modifications can be made therein without departing from the spirit and scope thereof.

What is claimed is:

1. A silver halide black and white photographic material for printing a developed transparent color photographic material, comprising a support having thereon at least one light-sensitive silver halide emulsion layer, wherein each of said at least one emulsion layer is composed of a silver halide emulsion which maintains a spectral sensitivity substantially only between 520 nm and 620 nm and contains substantially no iodine, and wherein the spectral sensitivities of the emulsion layers of the silver halide black and white photographic material are substantially only between 520 nm and 620 nm.

2. The silver halide black and white photographic material as claimed in claim 1, wherein the support has a white color-reflective layer.

3. The silver halide black and white photographic material as claimed in claim 1, wherein the support is a paper support having polyethylene coating on both surfaces thereof.

4. The silver halide black and white photographic material as claimed in claim 1, wherein the developed transparent color photographic material is colored in yellow, magenta and cyan.

5. The silver halide black and white photographic material as claimed in claim 4, wherein the developed transparent color photographic material is a color negative photographic film.

6. The silver halide black and white photographic material as claimed in claim 1, wherein the thickness of the support is at least 200 $\mu$m.

7. The silver halide black and white photographic material as claimed in claim 1, wherein the mean grain size of the light-sensitive silver halide emulsion is at least 0.35 $\mu$m.

8. The silver halide black and white photographic material as claimed in claim 1, wherein the photographic material contains a compound having a sulfur atom as a toning agent in an amount of from $2\times10^{-4}$ to $2\times10^{-2}$ mol per mol of silver halide.

9. A silver halide black and white photographic material as claimed in claim 1, wherein the maximum density of each of said at least one photographic emulsion layer after exposure and processing is at least 2.0.

10. A silver halide black and white photographic material as claimed in claim 1, wherein the gradation of each of said at least one photographic emulsion layer after exposure and processing is from R110 to R70 as ISO range.

11. The silver halide black and white photographic material as claimed in claim 1, wherein the photographic material is provided with writability.

12. The silver halide black and white photographic material as claimed in claim 1, wherein the support is a matted support.

13. The silver halide black and white photographic material as claimed in claim 1, wherein a sensitizing dye is added to the silver halide emulsion in an amount of from $10^{-6}$ to $10^{-2}$ mol per mol of silver of the silver halide emulsion.

14. The silver halide black and white photographic material as claimed in claim 13, wherein a sensitizing dye is added to the silver halide emulsion in of from $10^{-5}$ to $10^{-3}$ mol per mol of silver of the silver halide emulsion.

15. A silver halide black and white photographic material as claimed in claim 1, wherein said emulsion layer is composed of plural silver halide emulsions wherein sensitizing dye(s) is (are) added to each of the plural silver halide emulsions and where the sensitizing dye(s) has (have) the same or substantially the same spectral sensitizing region.

16. A silver halide black and white photographic material as claimed in claim 1, wherein said emulsion layer is composed of plural silver halide emulsions, each of said plural silver halide emulsions being monodispersed.

17. A silver halide black and white photographic material as claimed in claim 1, wherein each of said at least one silver halide emulsion layer(s) provide(s) silver halide images which do(es) not substantially change in gradation response despite changes in color to which the silver halide black and white photographic material is exposed.

18. A silver halide black and white photographic material for printing a developed transparent color photographic material, comprising a support having thereon at least one light-sensitive silver halide emulsion layer, wherein each of said at lest one silver halide emulsion layer(s) contain(s) substantially no iodine and maintain(s) a spectral sensitivity such that a sensitivity (1) is measured by exposing without using a filter, a sensitivity (2) is measured by exposing through a sharp cut filter SC-52, a sensitivity (3) is measured by exposing through a sharp cut filter SC-62, Relative Sensitivity (A) is a sensitivity measured by dividing sensitivity (2) by sensitivity (1), Relative Sensitivity (B) is a sensitivity measured by dividing sensitivity (3) by sensitivity (1), and Relative Sensitivity (A) is at least 1/10 and Relative Sensitivity (B) is not more than 1/30, wherein each of said at least one light-sensitive silver halide emulsion layer is composed of a silver halide emulsion which contains 1 mol % or less of iodine, and wherein the spectral sensitivity of the emulsion layers of the silver halide black and white photographic material are substantially only between 520 nm and 620 nm.

* * * * *